US010670009B2

(12) United States Patent
Müller et al.

(10) Patent No.: US 10,670,009 B2
(45) Date of Patent: Jun. 2, 2020

(54) METHOD FOR CONTROLLING A RECIPROCATING PISTON PUMP AND DEVICE FOR CARRYING OUT THE METHOD

(71) Applicants: Thomas Magnete GmbH, Herdorf (DE); TECHNISCHE UNIVERSITAT DRESDEN, Dresden (DE)

(72) Inventors: Axel Müller, Siegen (DE); Thomas Kramer, Dresden (DE); Martin Petzold, Dresden (DE); Jürgen Weber, Dresden (DE); Olaf Ohligschlager, Grünebach (DE)

(73) Assignees: Thomas Magnete GmbH, Herdorf (DE); TECHNISCHE UNIVERSITAT DRESDEN, Dresden (DE)

( * ) Notice: Subject to any disclaimer, the term of this patent is extended or adjusted under 35 U.S.C. 154(b) by 388 days.

(21) Appl. No.: 15/503,258

(22) PCT Filed: Aug. 4, 2015

(86) PCT No.: PCT/EP2015/001604
§ 371 (c)(1),
(2) Date: Feb. 10, 2017

(87) PCT Pub. No.: WO2016/026551
PCT Pub. Date: Feb. 25, 2016

(65) Prior Publication Data

US 2017/0241413 A1 Aug. 24, 2017

(30) Foreign Application Priority Data

Aug. 19, 2014 (DE) ..... 10 2014 012 307

(51) Int. Cl.
*F04B 49/06* (2006.01)
*F04B 51/00* (2006.01)
(Continued)

(52) U.S. Cl.
CPC ..... *F04B 49/065* (2013.01); *F04B 17/04* (2013.01); *F04B 17/042* (2013.01); *F04B 19/22* (2013.01);
(Continued)

(58) Field of Classification Search
CPC ..... F01L 2009/0405; F01L 2009/0486; F01L 9/04; H01F 2007/185; H01F 7/1607;
(Continued)

(56) References Cited

U.S. PATENT DOCUMENTS 6,208,497 B1 * 3/2001 Seale ..... F01L 9/04 361/154
6,945,770 B1 9/2005 Blaschke et al.
(Continued)

FOREIGN PATENT DOCUMENTS

DE 10020896 A1 10/2001
DE 10033923 A1 1/2002
(Continued)

OTHER PUBLICATIONS

Kallenbach, Matthias,: "Design of magnetic mini-and micro-actuators with highly non-linear magnetic circuits", Dissertation, Feb. 8, 1972, Leipzig, Germany (with English Abstract).
(Continued)

*Primary Examiner* — Dominick L Plakkoottam
(74) *Attorney, Agent, or Firm* — Harness, Dickey & Pierce, P.L.C.

(57) ABSTRACT

A controller of an electromagnetically driven reciprocating pump influences velocity of the magnetic armature by switching voltage applied to the electromagnet depending on the position of the magnetic armature, its position determined from state variables of the electromagnet. A processor calculates electrical resistance of the magnetic coil from the voltage and current measured by the measuring device, and
(Continued)

calculates the temporal change of the linked magnetic flux in the electromagnet from the electrical voltage, the current and the resistance of the magnetic coil, and calculates the linked magnetic flux in the electromagnet from an earlier magnetic flux and from the temporal change, and determines the position of the magnetic armature from the linked magnetic flux in the electromagnet and the electrical current through the magnetic coil, and switches the voltage at the magnetic coil by the switching device depending on the position of the magnetic armature.

15 Claims, 1 Drawing Sheet

(51) Int. Cl.

| | |
|---|---|
| ***H01F 7/18*** | (2006.01) |
| ***H01F 7/08*** | (2006.01) |
| ***F04B 19/22*** | (2006.01) |
| ***F04B 17/04*** | (2006.01) |

(52) U.S. Cl.
CPC ..... *F04B 49/06* (2013.01); *F04B 51/00* (2013.01); *H01F 7/081* (2013.01); *H01F 7/1844* (2013.01); *H01F 2007/185* (2013.01); *H01F 2007/1855* (2013.01)

(58) Field of Classification Search
CPC ..... H01F 7/1844; H01F 2007/1855; H01F 2007/1866; H01F 2007/1894; H01F 7/08; H01F 7/13; H01F 7/18; F04B 17/04; F04B 17/042; F04B 19/22; F04B 35/04; F04B 49/06; F04B 49/065; F04B 51/00
See application file for complete search history.

(56) References Cited

U.S. PATENT DOCUMENTS

| | | | | |
|---|---|---|---|---|
| 2001/0043450 | A1* | 11/2001 | Seale ..... | F01L 9/04 361/160 |
| 2015/0357107 | A1* | 12/2015 | Fochtman ..... | H01F 7/08 417/53 |

FOREIGN PATENT DOCUMENTS

| | | | |
|---|---|---|---|
| DE | 10127996 | A1 | 12/2002 |
| DE | 102004002454 | A1 | 8/2005 |
| DE | 19982757 | B4 | 6/2009 |
| DE | 102011088699 | A1 | 6/2013 |

OTHER PUBLICATIONS

International Search Report for PCT/EP2015/001604, ISA EP, Rijswijk, NL, dated Dec. 9, 2015.
Written Opinion of the ISA for PCT/EP2015/001604, ISA EP, Rijswijk, NL, dated Dec. 9, 2015.
Hayt, Engineering Electromagnetics, ISBN 0-07-027395-2, pp. 328-333, 352-353. © 1981.

* cited by examiner

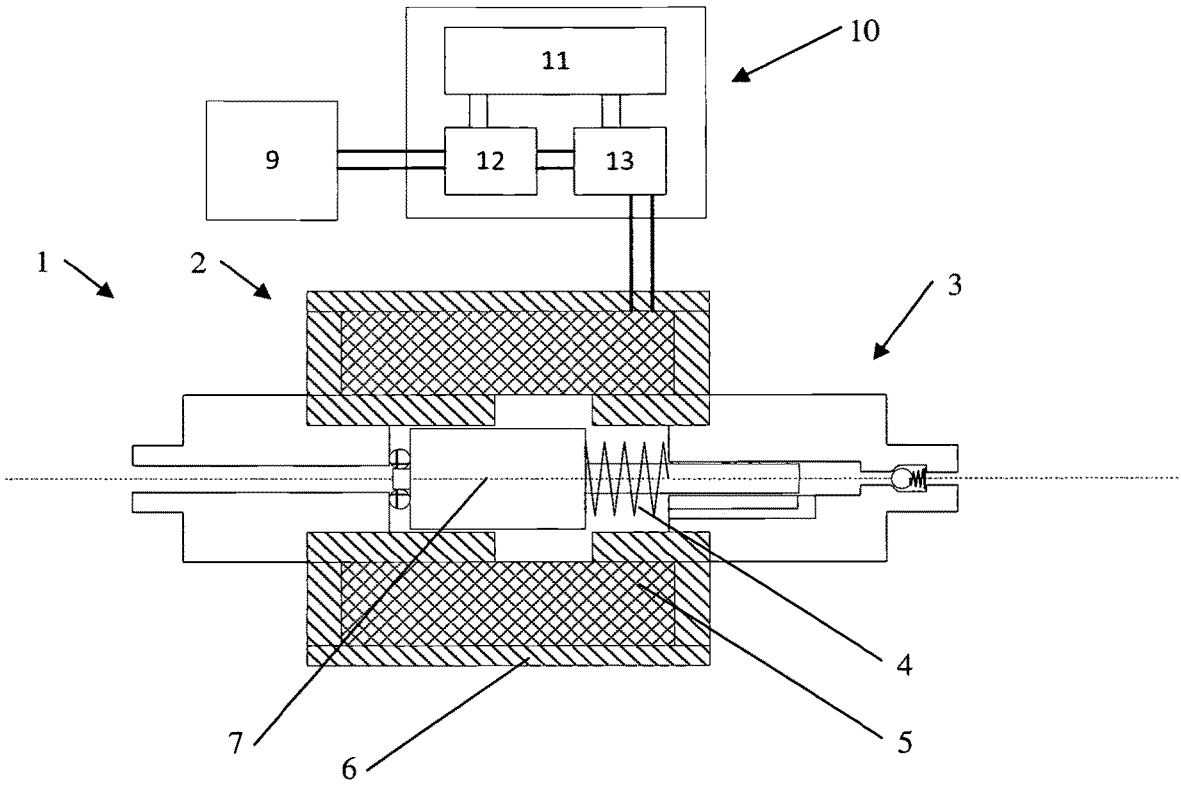
10
11
9
12
13
1
2
3
4
5
6
7

METHOD FOR CONTROLLING A RECIPROCATING PISTON PUMP AND DEVICE FOR CARRYING OUT THE METHOD

CROSS REFERENCE TO RELATED APPLICATIONS

This application is a 371 National Stage of International Application No. PCT/EP2015/001604, filed on Aug. 4, 2015, which claims the benefit of and priority to German Patent Application 10 2014 012 307.3, filed on Aug. 19, 2014. The entire disclosures of the above applications are incorporated by reference herein.

FIELD

The disclosure relates to a method for the control of a reciprocating pump and an apparatus for using the method.

BACKGROUND

This section provides background information related to the present disclosure which is not necessarily prior art.

Electromagnetically driven reciprocating pumps are used to convey and meter fuels and reagents. They can be manufactured economically, and can, due to their pulsed mode of operation, be operated with adjustable conveyed quantities if the frequency of the pulse is changed.

Electromagnetically driven reciprocating pumps consist of an electromagnet and a fluid displacement unit into which the working fluid is sucked, from which it is ejected and subjected to pressure. The electromagnet and the displacement unit are in most cases inseparably connected together by common components, and if the structural form of a through-flow electromagnet is chosen, no rod seal is needed between the electromagnet and the displacement unit.

One disadvantage of the usual mode of operation of these displacement pumps is associated with current being fed through the magnetic coil until the movement of the magnetic armature has finished, or even for a longer period; this is necessary if a complete travel is to be achieved under all operating conditions without taking further measures.

The current feed described above results in a hard impact of the magnetic armature, with correspondingly high noise and low efficiency of the electromagnetic drive.

A hard impact also correspondingly results during a return of the magnetic armature to the rest position if the return springs move the magnetic armature back without braking when the electromagnet is switched off.

Various methods for overcoming the said disadvantages are known from the patent literature, but these are in some cases very expensive and in some cases unsatisfactory.

- Document DE 199 82 757 B4 describes a method for driving a fuel metering pump in which both electrical and fluid state variables are measured, and the measured values are used to change the voltage at the electromagnet.
- Document DE 10 2004 002 454 B4 describes a method for operating a metering pump in which a duty ratio for modulation of the supply voltage is changed during a drive interval.
- Document DE 101 27 996 A1 describes a pump apparatus and a regulation apparatus in which the position of the magnetic armature is deduced from a measurement of the curve of the coil current, and the voltage is switched depending on the position, in order to brake the magnetic armature before it reaches the end stop.
- Document DE 100 33 923 A1 describes a method for determining the velocity and position of electromagnetic actuation systems without using sensors. The position is determined here from the changes in voltage and current caused by the movement of the armature.
- Document DE 100 20 896 A1 describes a method for determining the position of an armature/a valve. The current in, and potentially the voltage drop across, an exciter coil is here determined, from which the magnetic flux through the exciter coil is determined. The displacement position is then determined by means of a characteristic map which represents the relationship between the flux and the position.

The known methods all exhibit at least the following disadvantages:

- The changes in the ambient conditions of the controller and the reciprocating pump, in particular changes to the supply voltage and to the coil temperature, are inadequately detected and considered, and this impairs the quality of the control method.
- The estimation method for the travel of the magnetic armature is not based on a mathematical model of the driving electromagnet, and this means that only a very rough approximation can be performed, in particular as a result of the non-linear behaviour of electromagnets.
- Existing knowledge about the electromagnet used, which can be determined on a test bench with reasonable effort, is inadequately recognized and considered, if at all, whereby again the quality of the control method suffers.

In the dissertation "Entwurf von magnetischen Mini- and Mikroaktoren mit stark nichtlinearem Magnetkreis" (Design of magnetic mini- and micro-actuators with highly non-linear magnetic circuits) by Dr. M. Kallenbach (TU Ilmenau), a method for estimating the position of a magnet on the basis of measured values of voltage and current and of calculated values for the linked magnetic flux is described; it also determines highly accurate values for the magnet position even for non-linear magnetic systems. An application of the method to the control of a reciprocating pump is not described.

SUMMARY

This disclosure addresses the object of describing a controller of an electromagnetically driven reciprocating pump which, by switching the voltage applied to the electromagnet depending on the position of the magnetic armature, influences the velocity of the magnetic armature. The position of the magnetic armature is not measured here, but is determined from other measured or calculated state variables of the electromagnet. Knowledge of important properties of the electromagnet, in particular non-linear properties, is to be acquired prior to the intended operation, and stored in a suitable form in the controller.

The method according to the disclosure is based on a mathematical model of the driving electromagnet, wherein the behaviour of the electromagnet over time is described by the state variables of voltage, coil current, coil resistance, linked magnetic flux, magnetic armature velocity and magnetic armature displacement. These state variables are independent of one another when considered simultaneously, but do influence one another dynamically.

While the voltage and the coil current are measured by means of a measuring device, the coil resistance is calculated from the voltage and the coil current. The linked magnetic flux of the electromagnet cannot be calculated simultaneously from the other state variables; only the first time-derivative of the linked magnetic flux can be calculated simultaneously from the voltage, the coil current and the coil resistance. The linked magnetic flux refers to the integral over the penetration area of all the local magnetic flux densities at the conceptually cut-through magnetic circuit.

The linked magnetic flux is preferably calculated by numerical integration on the basis of an initial value and its first time-derivative, and this can be done in real time, i.e. during the magnet travel, by a sufficiently powerful processor.

As an alternative to numerical integration of the state variables, other mathematical methods for calculation of the temporal progression of these state variables on the basis of simplified linear models can be used; this requires less processing power, but is less precise, since linear models cannot adequately represent the important non-linearities of an electromagnet.

With knowledge of the linked magnetic flux, this numerical integration can also calculate the acceleration, the velocity and the travel of the magnetic armature. The travel of the magnetic armature can, however, be read more accurately and quickly from a previously determined, stored table, in which the travel of the magnetic armature is entered as a function of the coil current and of the linked magnetic flux. A table of this sort shows the strong yet non-linear dependency of the linked magnetic flux as a function of the coil current on the variable air gap, and therefore on the magnet travel.

It is true that the use of this table is an estimation method, and is therefore subject to inaccuracies, but the table does take the special non-linear properties of the electromagnet being used into account, as can be recorded for the general type of these electromagnets through measurements on a test bench, and therefore on the whole allows a significantly greater precision.

A further improvement in the estimation of the magnetic armature travel can be achieved if measurements are made on a test bench for different effective voltages and for both possible directions of the voltage changes at the magnetic coil, and if different tables are prepared from them and used. The non-linear effects of the saturation of the iron, the magnetic hysteresis and of the eddy currents are thus incorporated in the table, and thereby in the estimation method.

The precision of the calculation of the linked magnetic flux can, if necessary, be improved further if, in the calculation of the linked magnetic flux, the initial magnetization of the magnetic armature and of the iron return path from the previous history of the temporal progression of the linked magnetic flux is taken into account as an initial value for the numerical integration. The iron return path consists of the magnetic flux-carrying components of the magnetic pole, the housing and the yoke, and thus forms, together with the magnetic armature, an approximately closed circuit, broken only by the air gap between the magnetic armature and the magnetic pole.

With knowledge of the travel of the magnetic armature, the effective voltage at the magnetic coil can be changed by the controller, for example by switching on or off or by a suitable pulse-width modulation or pulse-length modulation, in such a way that the magnetic armature is braked in good time before striking the respective end stop, both during the working movement and during the return movement of the magnetic armature. The effective voltage refers to the mean DC voltage that would have the same effect as the voltage created by modulation.

The calculation and estimation method described can also be used, with small changes, for the return travel of the magnetic armature. Current flows through the magnetic coil even during the return travel, since the coil inductance only allows the current to decay slowly. The current can be measured, and a conclusion drawn as to the linked magnetic flux.

If the magnetic armature travel estimated by the method described reaches such a value that it would be appropriate to brake the return travel movement, the electrical controller increases the effective voltage to a value that generates suitable braking.

A table for the travel, the coil current and the linked magnetic flux, determined for correspondingly small voltages and with negative voltage changes, is advantageously used here in the estimation of the magnetic armature travel. This allows the non-linear behaviour of the magnetic materials to be appropriately taken into account.

In summary, the disclosure is characterized in that, as far as at all possible, existing knowledge about the electromagnet is used in order to perform the most accurate possible estimation of the magnetic armature travel on the basis of the temporal progressions of the coil current and voltage.

Reciprocating pumps of the type described and their electrical controllers are used to convey and/or meter fuels and reagents in vehicles and in mobile working machines.

DRAWINGS

FIG. 1 shows the apparatus consisting of the reciprocating pump and electrical controller.

DETAILED DESCRIPTION

Exemplary Embodiment

The apparatus according to FIG. 1 consists of a reciprocating pump (1) and an electrical controller (10), wherein the reciprocating pump consists of an electromagnet (2) and of a displacement unit (3) loaded by a spring (4).

The electromagnet is built from a magnetic coil (5), an iron return path (6) and a magnetic armature (7).

An electrical power supply (9) makes electrical power available to the apparatus, wherein the voltage can vary over a specified range, for example between 9 V and 16 V.

In an electrical controller (10), the electrical voltage is switched by means of a switching device (12), and the effective voltage and the resulting current are measured in a measuring device (13).

The magnetic coil is supplied with pulsed electrical power by the electrical controller (10), said electrical controller (10) also containing a processor (11) with programmable memory.

The processor (11) calculates

- the electrical resistance of the magnetic coil (5) from the values of the electrical voltage and the electrical current measured by the measuring device (13)
- the temporal change of the linked magnetic flux in the electromagnet (2) from the electrical voltage, the electrical current and the electrical resistance of the magnetic coil (5)
- the linked magnetic flux in the electromagnet (2) from a previously calculated or estimated magnetic flux and the temporal change The position of the magnetic armature (7) is determined by means of the calculated value of the linked magnetic flux and the measured electrical current through the magnetic coil (5).

The electrical voltage at the magnetic coil (5) is switched by means of the switching device (12) depending on the position of the magnetic armature (7).

The present position of the magnetic armature is determined using an estimation process in the controller (11) from at least one table calculated prior to intended operation of the controller (10) and stored in the controller (11) with associated values of the electrical current, the linked magnetic flux and the position of the magnetic armature (7).

Advantageously the calculation of the linked magnetic flux is improved in that the calculation of the linked magnetic flux takes into account the initial magnetization of the magnetic armature (7) and of the iron return path (6) from the previous history of the temporal progression of the linked magnetic flux by means of the starting value.

A further improvement in the estimation of the position of the magnetic armature (7) is achieved in that, with different effective voltages and voltage changes at the magnetic coil (5), corresponding previously determined tables for different voltages and voltage changes, with respectively assigned values of the electrical current, the linked magnetic flux, and the position of the magnetic armature (7), are used. The effects of the non-linearity of the material properties, the magnetic hysteresis and the eddy currents are thus included in the estimation method.

The determination of the linked magnetic flux in the electromagnet (2) is advantageously carried out in the memory-programmable processor (11) through a calculation of the electrical and magnetic state variables of the electromagnet using a numerical integration running in real time.

Depending on the position of the magnetic armature (7) the electrical voltage at the magnetic coil (5) is if necessary switched off, or switched off and on a plurality of times, in the electrical controller (10) by means of the switching device (12), so that the effective voltage in the sense of a pulse-width modulation or of a pulse-length modulation has a time-average whose effect is reduced in comparison with the voltage of a voltage supply (9). When the magnetic armature (7) is moving forward against the force of the spring (4), the movement of the magnetic armature can in this way be braked to the extent that the magnetic armature only runs against its front stop at a very low residual velocity.

As the magnetic armature (7) is returned by the spring (4), the current through the magnetic coil only decays very slowly due to the inductance of the coil. Here again the current through the magnetic coil is measured by the measuring device (13) and is used in the calculation of the linked magnetic flux for determination of the position of the magnetic armature, wherein a previously calculated table for small voltages and negative voltage changes, also containing the coil current and the linked magnetic flux, is selected for the magnetic armature travel.

In this type of operation the information about the position of the magnetic armature is used in the electrical controller (10) in order to increase the effective mean voltage at the magnetic coil (5) depending on the position of the magnetic armature, and thus to brake the movement of the magnetic armature.

LIST OF REFERENCE SIGNS

1. Reciprocating pump
2. Electromagnet
3. Displacement unit
4. Spring
5. Magnetic coil
6. Iron return path
7. Magnetic armature
9. Voltage supply
10. Electrical controller
11. Memory-programmable processor
12. Switching device
13. Measuring device

The invention claimed is:

1. A method for the control of a reciprocating pump having an electromagnet and a displacement unit loaded by a spring, wherein the electromagnet is built of a magnetic coil, an iron return path, and a magnetic armature, wherein the control is by an electrical controller that comprises a memory-programmable processor, a switching device, and a measuring device, the method comprising:

calculating with the processor an electrical resistance of the magnetic coil from measured values of an electrical voltage and of an electrical current measured by the measuring device;

calculating with the processor a temporal change of a linked magnetic flux in the electromagnet from the measured values of the electrical voltage and the values of the electrical current and the calculated electrical resistance of the magnetic coil;

calculating with the processor the linked magnetic flux in the electromagnet from a previously calculated or estimated magnetic flux and the temporal change;

determining the present position of the magnetic armature using an estimation process performed by the processor by accessing a predetermined value from a previously determined table, wherein the previously determined table includes the predetermined values determined by measurements and/or calculations prior to operation of the electrical controller and the predetermined values are stored in a memory and accessed by the processor, wherein the predetermined values include associated values of a predetermined table electrical current, a predetermined table linked magnetic flux, and a predetermined table position of the magnetic armature;

wherein the estimation of the position of the magnetic armature is based on different effective voltages at the magnetic coil and the previously determined table that includes the predetermined values of the voltage and/or the voltage change with previously associated values of the predetermined table electrical current and the predetermined table linked magnetic flux related to the predetermined table position of the magnetic armature; and changing an effective electrical voltage at the magnetic coil depending on the determined present position of the magnetic armature.

2. The method for the control of a reciprocating pump according to claim 1, wherein the calculation of the linked magnetic flux utilizes an initial magnetization of the magnetic armature and of the iron return path such that a previous history of a temporal progression of the linked magnetic flux is taken into account during the calculation of the linked magnetic flux in a numerical integration.

3. The method for the control of a reciprocating pump according to claim 1, wherein the calculation of the linked magnetic flux in the electromagnet is performed by a numerical integration of electrical and magnetic state variables of the electromagnet carried out in real time.

4. The method for the control of a reciprocating pump according to claim 1, wherein the effective electrical voltage at the magnetic coil is effectively time-average reduced in comparison to a voltage of a voltage supply by being switched with the switching device to at least one of off, or switched off and on a plurality of times, depending on the position of the magnetic armature.

5. The method for the control of a reciprocating pump according to claim 1, wherein during the return of the magnetic armature by the spring the electrical current through the magnetic coil, decaying slowly due to the coil inductance, is measured by the measuring device and is used through the calculation of the linked magnetic flux to determine the position of the magnetic armature, wherein the previously calculated table with associated values of the electrical current, the linked magnetic flux and the position of the magnetic armature, said table being selected according to a low effective voltage and a negative voltage change, is used.

6. The method for the control of a reciprocating pump according to claim 5, wherein during the return of the magnetic armature by the spring, the determined present position of the magnetic armature is used in the electrical controller in order to increase the effective voltage at the magnetic coil depending on the position of the magnetic armature, and thus to brake the movement of the magnetic armature.

7. An apparatus for performing the method according to claim 1, wherein the apparatus consists of the reciprocating pump and the electrical controller and wherein the reciprocating pump consists of the electromagnet and the displacement unit loaded by the spring, wherein the electromagnet is built of the magnetic coil, the iron return path and the magnetic armature, and wherein the electrical controller comprises the memory-programmable processor, the switching device and the measuring device, wherein the memory-programmable processor contains at least one table calculated prior to intended operation of the controller, with associated values of the electrical current through the magnetic coil, the linked magnetic flux in the electromagnet and the position of the magnetic armature, wherein this table or these tables allow the processor, on the basis of a plurality of measurements of the electrical current by a measuring device, to determine the position of the magnetic armature by an estimation procedure.

8. The apparatus according to claim 7, wherein, by the memory-programmable processor and the switching device, the electrical controller lowers the effective mean electrical voltage at the magnetic coil depending on the armature travel relative to the voltage of a voltage supply such that the curve of the velocity of the magnetic armature is influenced in a manner specified in the processor, wherein the voltage supply feeds electrical power to the switching device and also to the measuring device and furthermore to the magnetic coil.

9. The method of claim 1, further comprising: operating the switching device to cause the changing of the effective electrical voltage at the magnetic coil.

10. The method of claim 9, wherein operating the switching device includes at least one of:

(i) switching off an electrical voltage at the magnetic coil; or (ii) repeatedly switching off and switching on the electrical voltage at the magnetic coil;

wherein the switching device is operable cause the effective voltage at the magnetic coil to differ from that of a voltage supply.

11. A method to control a reciprocating pump by an electrical controller, wherein the electrical controller comprises a memory-programmable processor, a switching device, and a measuring device, wherein the reciprocating pump has an electromagnet and a displacement unit loaded by a spring the electromagnet comprises a magnetic coil, an iron return path, and a magnetic armature, the method comprising:

operating the processor to:

access a previously determined table determined by measurements and/or calculations prior to operation of the reciprocating pump and stored in a memory, wherein the previously determined table includes a test position of the magnetic armature based on an electrical current test value through the magnetic coil and a linked magnetic flux test value in the magnetic coil;

calculate a present electrical resistance of the magnetic coil from a measured present value of an electrical voltage at the magnetic coil and a present measured value of an electrical current through the magnetic coil, wherein the measuring device is operable to measure the present values of the electrical voltage at the magnetic coil and of the electrical current through the magnetic coil;

calculate a present linked magnetic flux in the electromagnet based at least in part on the measured present values of the electrical voltage and the electrical current and the calculated present electrical resistance;

determine a present position of the magnetic armature using an estimation process, wherein the estimation process is based at least in part on the accessed previously determined table that includes the electrical current test value through the magnetic coil and the linked magnetic flux test value in the magnetic coil and the prior determined related position of the magnetic armature, wherein the determination includes comparing (i) the calculated present linked magnetic flux to the linked magnetic flux test value and (ii) the measured present value of the electrical current to determine the present position of the magnetic armature by comparison to the test position of the magnetic armature; and changing an effective electrical voltage at the magnetic coil by adjusting the switching device depending on the determined present position of the magnetic armature.

12. The method of claim 11, further comprising:

measuring the present values of the electrical voltage at the magnetic coil and of the electrical current through the magnetic coil.

13. The method of claim 11, wherein operating the processor to calculate a present linked magnetic flux in the electromagnet further comprises:

calculate a temporal change of a linked magnetic flux in the electromagnet from the measured electrical voltage, the measured electrical current, and the calculated electrical resistance of the magnetic coil;

calculate a present linked magnetic flux in the electromagnet from a previously calculated or estimated magnetic flux and the calculated temporal change of the linked magnetic flux.

14. The method of claim 13, wherein the calculated temporal change of the linked magnetic flux is relative to an initial magnetization of the iron return path the magnetic armature.

15. The method of claim 14, wherein the calculated temporal change of the linked magnetic includes a previous history of the temporal progression of the linked magnetic flux from a previously determined starting value of the linked magnetic flux test value in the magnetic coil.

* * * * *